US005743574A

United States Patent [19]

Kohn

[11] Patent Number: 5,743,574

[45] Date of Patent: Apr. 28, 1998

[54] ONE-PIECE PIERCE-LOCK DOUBLE-ENGAGEMENT CABLE-SEAL

[75] Inventor: Raymond F. Kohn, Magnolia, Tex.

[73] Assignee: PCI-Products Company International, Inc., Houston, Tex.

[21] Appl. No.: 761,303

[22] Filed: Dec. 6, 1996

[51] Int. Cl.[6] ..... B65D 27/30; B65D 33/34; B65D 55/06

[52] U.S. Cl. ..... 292/315; 292/326; 403/283

[58] Field of Search ..... 292/307 R, 315, 292/326, 317; 403/283, 294, 297

[56] References Cited

U.S. PATENT DOCUMENTS

| | | | |
|---|---|---|---|
| 3,466,712 | 9/1969 | Behney | 403/283 |
| 3,730,578 | 5/1973 | Gerlach | 292/318 |
| 3,770,307 | 11/1973 | Van Gompel | 292/307 R |
| 3,937,507 | 2/1976 | McCoag | 292/319 |
| 3,945,671 | 3/1976 | Gerlach | 292/323 |
| 3,980,337 | 9/1976 | Moberg et al. | 292/319 |
| 3,994,521 | 11/1976 | Van Gompel | 292/319 |
| 4,049,303 | 9/1977 | Irwin et al. | 292/307 R |
| 4,074,916 | 2/1978 | Schindler | 292/307 R |
| 4,075,742 | 2/1978 | Remark et al. | 24/211 R |
| 4,280,726 | 7/1981 | McCoag | 292/327 |
| 4,312,529 | 1/1982 | Gillette | 292/315 |
| 4,342,477 | 8/1982 | McClure | 292/307 |
| 4,534,097 | 8/1985 | Mason | 403/283 X |
| 4,607,414 | 8/1986 | Six | 292/315 X |
| 4,640,538 | 2/1987 | Brammall | 292/323 |
| 4,747,631 | 5/1988 | Loynes et al. | 292/307 |

*Primary Examiner*—Neill R. Wilson

[57] ABSTRACT

A one-piece high-security cable type seal-lock having a locking body (10) consisting of: A length of multi-stranded cable (50) having one cable end (51) permanently attached to locking body (10) within a through hole identified as fixed cable hole (11). A longitudinal cylindrical through hole (14) running approximately parallel to fixed cable hole (11) and having a centrally located annular recessed groove, thereby creating center expansion cavity (25). A locking pin (40) is held in place within locking body (10) and positioned approximately perpendicular to, and centrally located above, free cable end (52). When installed, locking pin (40) is forcibly pushed down until it pierces free cable end (52) thereby staking the cable in place and simultaneously creating cable bulge (53). The enlarged diameter of cable bulge (53) within center expansion cavity (25) is unable to be removed from locking body (10) via the lessor diameters of adjacent first guide hole (20) or second guide hole (22). Thus, permanently securing the one-piece pierce-lock double-engagement cable-seal in place.

8 Claims, 3 Drawing Sheets

ONE-PIECE PIERCE-LOCK DOUBLE-ENGAGEMENT CABLE-SEAL

BACKGROUND—FIELD OF INVENTION

This invention relates to a keyless lockable security device, specifically a high-security seal, or seal-lock which secures the access doors of rail cars, trailer tracks, cargo containers, and tank car hatches.

BACKGROUND—DESCRIPTION OF THE PRIOR ART

The access doors of railroad cars, trailer trucks, cargo containers, and tank car hatches are customarily closed with a seal which is installed on the hasp of the access door or hatch. The primary function of the seal is to indicate if the door or hatch had been opened by unauthorized personnel. Once secured, the seal should provide a permanent closure which cannot be opened without resulting in significant visible damage and the destruction of the seal device, which prevents its reuse. If the seal can be opened, by any means whatsoever, without resulting in visible damage and the destruction of the seal, thereby allowing the seal to be reused and appear intact, it has failed to perform its primary function.

Various forms of seals have been used in the past on the access doors of trucks, rail cars, and cargo containers. Conventional seals frequently have consisted of a metal tape or a plastic band with a single securement member, which when engaged therewith, it is impossible to remove the seal without the destruction of the securement member, or the tape, or band. The prime purpose of these conventional seals has not been to secure the access doors from unauthorized entry, but for the purpose of indicating that such unauthorized access had been made.

In recent years the increase in thefts from trailer trucks, rail cars, and cargo containers has resulted in a new type of seal which embodies all the characteristics of a conventional seal in addition to providing increased strength and security by being constructed of heavier and more substantial materials, often times requiring the use of special tools to effect removal. These new types of seals have been rightly termed high-security seals, or seal-locks. High-security seals which utilize a flexible metal cable have been further referred to as cable-locks.

Seal-locks are a more practical solution than padlocks. It has been impractical to lock containers with padlocks, because of the problem of transferring keys or combinations. In addition, the complex mechanical construction of padlocks results in them being an expensive security alternative to seal-locks. Once a seal-lock is engaged, it is intended that it cannot be disengaged without destroying the seal, thereby preventing its reuse. Thus, the single use of the seal requires that the seal-lock be low cost yet effectively provide a high level of security protection.

Heretofore, several types of seal-locks have been proposed. One type of seal-lock construction requires the assembly of two separate pieces. Seal-locks of this type are known from U.S. Pat. Nos. 4,280,726 to McCoag (1981), 4,075,742 to Remark et al. (1978), 3,980,337 to Moberg and Lundberg (1976), 3,994,521 to Van Gompel (1976), 3,730,578 to Gerlach (1973) and 3,945,671 to Gerlach (1976). When a seal-lock is constructed with two separate pieces, the loss of either piece, prior to use, renders the seal useless. Thus a person using this type of seal must maintain a careful inventory and count of both pieces to avoid misplacing one portion of the seal-lock. This is an inconvenient and difficult task to perform while operating a busy cargo terminal facility, and when seal-lock components are bulk packaged in cartons, the user would not be aware of any shortages of a given component until the last seals from the carton were used.

Several embodiments of the above mentioned prior art utilize a bolt member as one of the components of the seal-lock as shown in U.S. Pat. No. 3,945,671 to Gerlach (1976). The typical hole diameter of the access door hasp limits the diameter of the shaft of the bolt to a maximum of ⅜" diameter. Such bolt member is typically a cold-headed part. The process of cold-heading has certain physical and economic limitations regarding the maximum diameter head that an be achieved when a ⅜" diameter shaft is used. In practice this manufacturing consideration limits the head diameter of the bolt member to ¾".

In many rail cars, track trailers, and cargo containers the hole diameter of the locking hasp of the access doors is larger than ¾". This increased hole diameter is as a result of years of wear, manufacturing variations, or damage. In either case, a seal-lock having a bolt member with a ¾" diameter head is useless on any hasp having a hole diameter of ¾" or larger. Padlock type seal-locks and seal-locks which utilize a looped length of stranded cable recognize this limitation and utilize either a "U" shaped padlock shackle as shown on U.S. Pat. No. 3,937,507 to McCoag (1976), or a length of stranded cable which creates a closed loop when inserted into the locking body of the seal as shown on U.S. Pat. No. 3,980,337 to Moberg and Lundberg (1976).

Many rail cars, track trailers, cargo containers, and especially tank car hatch doors have the hole of the locking hasp partially obstructed by other door hardware components therefore making it difficult or impossible to install rigid seal-locks which require sufficient clearance above and below the hole of the locking hasp to effect an installation. Heretofore several types of seal-locks have been proposed to address this problem of inaccessibility by means of a flexible metal cable which is threaded through the locking hasp and around any obstructions prior to securement. This type of seal is referred to as a cable-lock seal and are shown in U.S. Pat. Nos. 3,770,307 to Van Gompel (1973), 4,049,303 to Irwin et al. (1977), 4,640,538 to Brammall (1987), 4,074,916 to Schindler (1978), and 4,747,631 to Loynes (and others 1988), these examples of prior art all utilize a flexible metal cable which is secured in place by various internal securement mechanisms which are located within the locking body of the seal. These various internal securement mechanisms, as shown in prior art, apply pressure and friction to the cable as the securement means.

High-security seals, seal-locks, and cable-locks, derive their strength by utilizing heavier metal components in their construction. The use of stronger materials increases the difficulty in breaking the seal-lock open. When an attempt is made to open a seal-lock by force, it is important that the seal perform its primary function, as stated above, and be destroyed by such an attempt. However, the same heavier metal components which increase the difficulty of breaking the seal open, also transfer most of the forces being applied to the seal, during a forced entry, directly to the locking mechanisms which were designed as the securement means. My testing indicates that the relative strength of the securement locking mechanisms of seal-locks shown in prior art is significantly less than the strength of the other components of the seal-lock. Therefore, when sufficient forces are applied to the seal-locks that have been previously proposed, the locking mechanisms release or slip before any visible damage is done to the seal-lock and its related components, thereby allowing the seal-lock to be opened and reused without apparent indications of tampering.

Heretofore, the cable-lock type seals, which utilize a length of flexible cable, that have been previously proposed, have used a variety of internal disks or balls within the locking body member which exert pressure and friction against the flexible cable as the securement means as shown in U.S. Pat. Nos. 3,994,521 to Van Gompel (1976), 4,074,916 to Schindler (1978), 4,747,631 to Loynes et al. (1988), 4,640,538 to Brammall (1987) and 3,770,307 to Van Gompel (1973). A securement means which utilizes friction and pressure to secure the cable in place is vulnerable to manipulation and slippage. My testing indicates that when sufficient force, and or manipulation, is applied to the cable, the cable can be removed from the locking body thereby allowing the seal to be opened without visible signs of tampering or damage. Once opened in this fashion the cable can be reinserted into the locking body to appear intact. Therefore, this type of securement means fails to perform its primary function which requires that the seal be totally destroyed and rendered unusable when forcibly opened.

An additional problem associated with cable-locks, which have been previously prepossed, occurs when the flexible cable is inserted into the locking body just enough to secure the end of the cable in place but failing to pull the cable far enough through the locking body to tighten the closed loop portion, or shackle, of the cable around the hasp, thereby giving the appearance of a fully secured seal which is loosely hanging from the hasp. At a later date, unauthorized personnel could cut the cable at a point just prior to its entrance into the locking body thereby opening the seal while pulling the short cut length of cable out of the locking body and discarding it, then, said unauthorized personnel could reinsert the remaining attached portion of the cable into the locking body once again, thereby properly re-securing the cable within the locking body allowing the seal to appear intact. The only visible evidence of tampering would be the remaining slightly shorter length of cable which could easily go unnoticed. This problem is so pervasive in the industry served by the cable-lock seals previously proposed that the industry has identified this event as "short-cutting" a seal.

An additional problem associated with the cable-locks previously proposed is the complicated and numerous interrelated internal mechanisms and components which result in a seal-lock which is both more costly and difficult to manufacture than an embodiment having fewer components.

One such embodiment having fewer internal components is shown on U.S. Pat. No. 4,342,477 to McClure (1982). However, this embodiment also utilizes friction and pressure as the cable securement means. The friction and pressure, which secures the cable in place, is created by means of a break-off screw. The break-off screw is tightened in place by means of an attached handle. As the screw is tightened in place the cable is pressed into a recessed area thereby deflecting the cable. As the screw is tightened it eventually meets sufficient resistance from further tightening pressure which results in the handle breaking away from the screw thereby leaving the tightened screw in place, while the handle is discarded and thrown away. A carelessly discarded break-away handle poses a variety of hazards to both vehicles and pedestrians, such as the puncturing of vehicle tires or pedestrian foot injuries. This prior art has additional limitations when utilizing a larger diameter cable member. If a large diameter cable were to be used in this embodiment, for the purpose of providing greater strength and security protection, the larger diameter cable would be less flexible and considerably more rigid in construction, therefore the larger diameter cable would not deflect into the recessed area of the locking body before the attached handle breaks off, thereby limiting the use of this embodiment to only a small diameter and a more flexible cable member.

The present invention is designed toward overcoming one or more of the problems set forth above.

SUMMARY OF INVENTION

It is therefore, an object of this invention to provide a one-piece double-engagement permanently secured high-security seal or seal-lock, and more specifically, a type of seal-lock that is commonly referred to as a cable-lock seal, or cable-seal, which once engaged, cannot be removed by means of force or manipulation without the complete destruction of the seal.

Accordingly, besides the objects and advantages of the one-piece pierce-lock double-engagement cable-seal described in my patent, several objects and advantages of the present invention are as follows:

(a) The present invention incorporates a locking body having a length of flexible cable with one end permanently fixed and secured within one side of the locking body and a locking pin which is firmly held in place within a guide hole in the locking body prior to use, thereby creating a one-piece seal which eliminates the problem associated with the lost components of two piece seals.

(b) The present invention can be applied to any hasp, even one having a hole diameter which is larger than ¾". The secured loop created by the cable creates a flexible shackle which will fit through any size locking hasp hole which has a diameter that is marginally larger than the cable diameter. This eliminates the problem associated with bolt type seal-locks which have a ¾" diameter head on the bolt member which can easily pass through the hole in a hasp when such hole exceeds ¾".

(c) The present invention uses a double-engagement securement method which utilizes the inherent properties and construction of the multi-stranded flexible cable, which permit the cable to be pierced and staked into position by a suitable locking pin, and the dimensional size differentials of the various components to achieve its locked and secured position, thereby eliminating any vulnerability from forced entry, slippage, or manipulation which are inherent problems associated with friction and pressure securement methods utilized by seals previously prepossed.

(d) The present invention can be proportioned to accommodate various diameters of cable, and the pierce-lock securement method will continue to function properly. Prior art which utilizes a locking method which relies on the deflection of the cable to achieve its locked position can only be used with smaller diameter cables which are more flexible, however, the lessor cable diameters only provide marginal security protection due to the limited strength of small diameter cables. Therefore, the problem associated with using larger diameter cable, which is less flexible, has been eliminated, thereby allowing the locking mechanism of the present invention to be used with virtually any diameter cable.

(e) The present invention does not utilize any break-away components which are discarded after installation, thereby eliminating the hazards to vehicles and pedestrians when such seal components are improperly discarded.

(f) The present invention provides a seal with a positive securement method which when engaged, cannot be manipulated, forced, or cut in such a way as to permit re-engagement of the seal. The present invention eliminates the "short cutting" problem associated with prior art which had permitted the cable to be cut just prior to its entrance into the locking body, and discarding the short cut length of cable while reusing the remaining cable to re-secure the seal in place. The present invention eliminates the problem of "short cutting" the cable since if the cable were cut just prior to its entrance into the locking body, this cut would have no effect on the cable securement means contained within the locking body, since the locking pin would remain securely in place, therefore, the staked cable, the cable bulge and the secured locking pin would continue to hold the remaining cable securely in place. The secured locking pin, and the secured cable remains, prevent any subsequent reuse of this invention, thereby eliminating the "short cutting" and reusability problems associated with seals previously prepossed.

(g) The present invention is constructed of three basic components, thereby eliminating the complex arrangement of numerous interrelated internal components of seals previously prepossed, and their associated higher manufacturing and assembly costs.

(h) The present invention provides a seal which utilizes a double-engagement securement method, thereby creating a stronger and more secure seal than have been previously prepossed.

Further objects and advantages are to provide a seal-lock which is simple to use, inexpensive to manufacture, creates a closed loop, or shackle, which can be drawn up tightly when installed and secured to the locking hasp, can be manufactured with various lengths of flexible cable for special applications, and requires that the seal be destroyed and rendered unusable when removed thereby preventing its reuse. Still further objects and advantages will become apparent from a consideration of the ensuing description and drawings.

BRIEF DESCRIPTION OF THE DRAWINGS

In the drawings, cross-sectional views of related figures have the same figure number with the added alphabetic suffix "A".

REFERENCE NUMERALS IN DRAWINGS

| | | | |
|---|---|---|---|
| 10 | locking body | 11 | fixed cable hole |
| 12 | parallel compression area | 14 | longitudinal cylindrical through hole |
| 15 | exit oriented through hole | | |
| 21 | first guide hole bevel | 20 | first guide hole |
| 23 | second guide hole bevel | 22 | second guide hole |
| 25 | center expansion cavity | 24 | exit guide hole |
| 28 | expansion cavity first bevel | 26 | exit oriented expansion cavity |
| 30 | locking pin guide hole | 29 | expansion cavity second bevel |
| 40 | locking pin | 35 | locking pin tip recess |
| 41 | locking pin tapered end | 40a | short locking pin |
| 42 | locking pin textured surface | 41a | locking pin cable recess |
| 43a | locking pin concave end | 43 | locking pin flat end |
| 51 | fixed cable end | 50 | multi-stranded flexible cable, or cable |
| 53 | cable bulge | 52 | free cable end |

DESCRIPTION OF THE PREFERRED EMBODIMENTS

Figure 1:
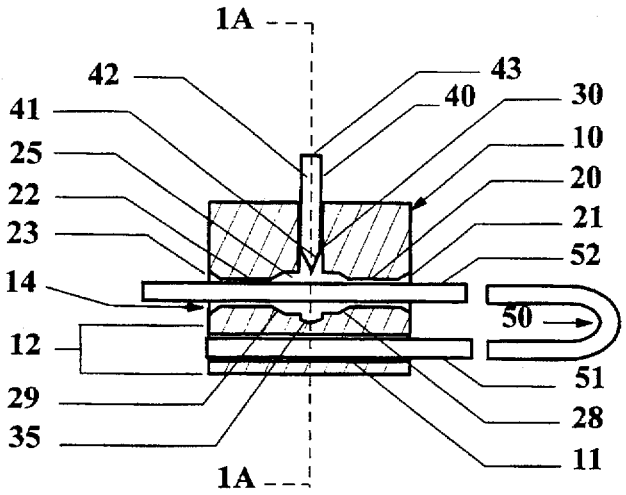
FIG. 1 is a vertical sectional view of the preferred first embodiment of the pierce-lock double-engagement cable-seal, having a center expansion cavity. This view represents the double-engagement pierce-lock cable-seal, with one end of the cable permanently installed within the locking body, and the free end of the multi-stranded flexible cable fully inserted through the longitudinal cylindrical through hole of the locking body, with the locking pin held in an open, un-locked position.
Figure 1A:
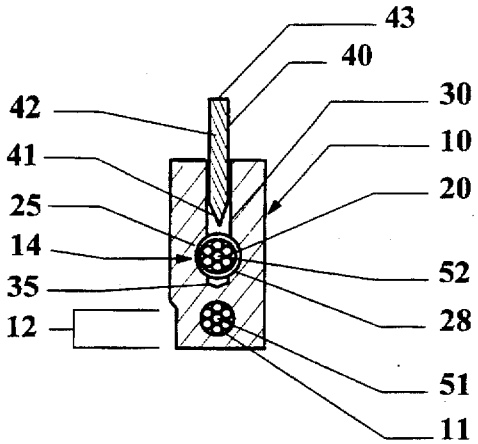
FIG. 1A is a cross-sectional view of FIG. 1 shown along viewing line 1A—1A of FIG. 1.
Figure 2:
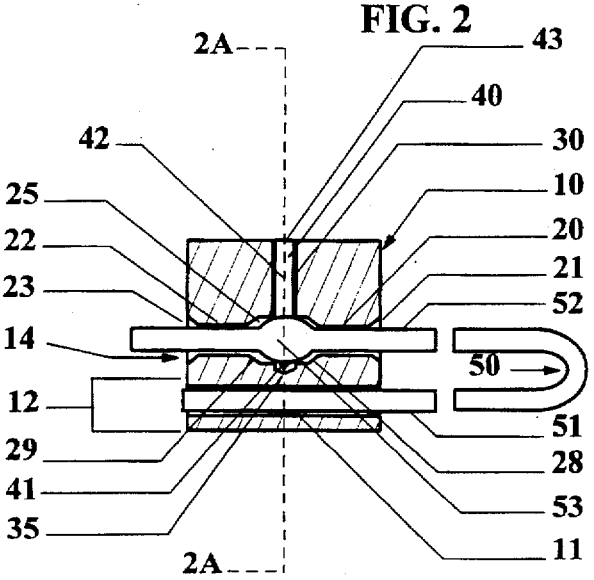
FIG. 2 is a vertical sectional view of the preferred first embodiment of the pierce-lock double-engagement cable-seal, having a center expansion cavity, of FIG. 1, shown with the locking pin in its closed and fully engaged locked position, thereby piercing the free end of the multi-stranded flexible cable causing the cable to bulge at the point of locking pin penetration, thus permanently securing the cable in place.
Figure 2A:
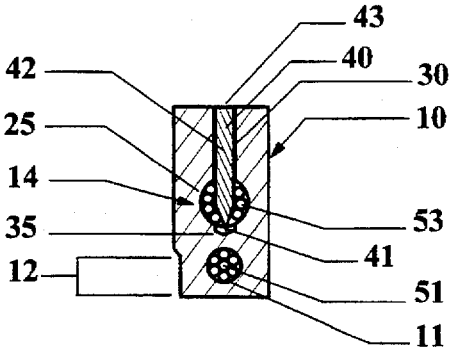
FIG. 2A is a cross-sectional view of FIG. 2 shown along viewing line 2A—2A of FIG. 2.

The preferred first embodiment of the one-piece pierce-lock double-engagement cable-seal of the present invention is illustrated in the following figures: FIG. 1 shows a vertical sectional view in the open, un-locked position. FIG. 1A shows a cross-sectional view of FIG. 1. FIG. 2 shows a vertical sectional view in the closed, fully engaged locked position. And, FIG. 2A shows a cross-sectional view of FIG. 2. The pierce-lock cable-seal is comprised of three basic components. The first component is a locking body generally indicated at 10. The second component is a locking pin indicated at 40. And, the third component is a suitable length of multi-stranded flexible cable generally indicated at 50.

Locking body 10 may be formed of any conventional material such as aluminum, steel or other materials that may be suitable. The overall dimensions, length, width and depth, of locking body 10 is suitably proportioned to accommodate the diameter of the selected cable 50 and the dimensionally related internal cavities and through holes within locking body 10. Therefore, a smaller diameter cable 50 would function properly with a locking body 10 having proportionately smaller overall and internal cavity dimensions, while a larger diameter cable 50 would require a locking body 10 having proportionately larger overall and internal cavity dimensions.

Locking body 10 has a through hole located near the lower edge of locking body 10, indicated as fixed cable hole 11. It should be noted that depending on the specific application and type of materials utilized, fixed cable hole 11 may also be configured as a blind hole, which is not shown in the attached FIG's due to its obviousness. Fixed cable hole 11 is of sufficient diameter to permit the insertion and permanent attachment of fixed cable end 51. Fixed cable end 51 is inserted into fixed cable hole 11 and is permanently pre-attached to locking body 10 by means of forcibly compressing locking body 10 along longitudinal compression area 12, with such compression covering an area sufficiently wide and parallel to fixed cable hole 11 and with sufficient compressive force as to compress fixed cable hole 11 against fixed cable end 51, thereby permanently attaching fixed cable end 51 to locking body 10 within fixed cable hole 11. Thus creating a locking body 10 having a suitable length of cable 50 with its fixed cable end 51 permanently pre-attached to locking body 10, thereby creating a one-piece seal.

Locking body 10 has a longitudinal cylindrical through hole generally indicated at 14, and positioned parallel to fixed cable hole 11, and located a minimal, but sufficient, distance away from parallel compression area 12 in order to prevent the compressive forces used to pre-attach fixed cable end 51 to locking body 10 from distorting or compressing any of the cavities or internal open areas comprising longitudinal cylindrical through hole 14. Longitudinal cylindrical through hole 14 is comprised of a first guide hole 20, and a second guide hole 22, each having similar diameters which are approximately the same diameter as the uniform diameter of cable 50, and providing sufficient clearances to permit the insertion and unobstructed through passage of free cable end 52.

Centrally located between first guide hold 20, and second guide hole 22 is an annular recessed groove having sufficient length and diameter to create a center expansion cavity 25. First guide hole 20, second guide hole 22, and center expansion cavity 25 are horizontally aligned on their respective center lines to permit free cable end 52 to pass freely through these areas which collectively comprise longitudinal cylindrical through hole 14.

The structural configuration of first guide hole 20 and second guide hole 22 are identical, thereby permitting free cable end 52 to be inserted from either direction. FIG. 1 shows free cable end 52 firstly inserted into first guide hole 20, passing through locking body 10, and exiting via second guide hole 22. However, free cable end 52 may alternately be inserted in the opposite direction by being first inserted into second guide hole 22, passing through locking body 10, and exiting via first guide hole 20. The alternate insertion method is considered an obvious alternative insertion method of the preferred first embodiment of FIGS. 1, 1A, 2, and 2A, and is therefore not shown in the attached FIG's.

Various annular bevels are provided at the entrance to, and along the cable's path within, longitudinal cylindrical through hole 14 to facilitate the insertion and unobstructed passage of free cable end 52. First guide hole bevel 21 facilitates the insertion of free cable end 52 into first guide hole 20. Alternately, second guide hole bevel 23 facilitates the insertion of free cable end 52 into second guide hole 22 when the free cable end 52 is alternately inserted in the opposite direction. Likewise, expansion cavity first bevel 28, and expansion cavity second bevel 29 facilitate the unobstructed passage of free cable end 52 through center expansion cavity 25 and into and through second guide hole 22 or alternately first guide hole 20.

Locking body 10 has a uniformly cylindrical blind hole positioned perpendicular to longitudinal cylindrical through hole 14. The uniformly cylindrical blind hole is identified as locking pin guide hole 30 and is centrally located with its vertical center line aligned with the longitudinal and horizontal center lines of center expansion cavity 25, thereby positioning and holding locking pin 40 directly above the center line of free cable end 52. Locking pin guide hole 30 is a blind hole terminating just beyond center expansion cavity 25, thereby creating a locking pin tip recess 35.

Locking pin 40 is a cylindrical shaft constructed of any suitable material having sufficient strength, rigidity, and hardness, to facilitate penetration and securement of free cable end 52. Locking pin 40 has an outside diameter which is equal to the diameter of locking pin guide hole 30, providing only adequate minimal clearance to allow locking pin 40 to slide within locking pin guide hole 30. Locking pin 40 is held in place within locking pin guide hole 30 by means of friction which is created by either the close tolerance fit between locking pin 40 and locking pin guide hole 30, or any suitable texture or surface treatment applied to the cylindrical surface of locking pin 40 and identified as locking pin textured surface 42. The close tolerance fit, or locking pin textured surface 42, holds locking pin 40 firmly in place within locking pin guide hole 30 in both its open position as shown in FIGS. 1 and 1A, and in its closed position as shown in FIGS. 2 and 2A, thus creating a one-piece seal.

FIGS. 1 and 1A illustrates the preferred embodiment of the one-piece pierce-lock double-engagement cable-seal in its open, un-locked position as it would appear to the user of this invention just prior to securement.

The leading end of locking pin 40 has a pointed tapered tip and is identified as locking pin tapered end 41. Locking pin tapered end 41 may be any tapered shape resulting in a point suitable for penetrating free cable end 52. FIGS. 1 and 1A illustrates locking pin 40 firmly held in place within locking pin guide hole 30 in its open, un-locked position with locking pin tapered end 41 positioned directly above free cable end 52, but, away from, and not obstructing the open cavity area comprising center expansion cavity 25, thus permitting the passage of free cable end 52 through longitudinal cylindrical through hole 14 without obstruction from any portion of locking pin 40 or its locking pin tapered end 41.

FIGS. 1 and 1A also illustrates locking pin 40 held in its open position with locking pin flat end 43, and the upper portion of locking pin 40, extending above the top surface of locking body 10. Locking pin 40 is of sufficient length so when fully locked in its closed position, as shown in FIGS. 2 and 2A, locking pin flat end 43 is flush with the top surface of locking body 10 while the point of locking pin tapered end 41 is positioned within locking pin tip recess 35. Thus, preventing access to, and removal of, locking pin 40 once it is fully locked in its closed position as shown in FIGS. 2 and 2A.

Locking pin 40 is appropriately sized and made of any suitable material of sufficient strength, rigidity, and hardness, to facilitate the penetration, expansion, and securement of cable 50. Cable 50 is made of any suitable material having a multi-stranded flexible construction, such as, but not limited to, ACSR steel cable or wire rope. The multi-stranded construction of the cable permits locking pin 40 to pierce and penetrate the strands of free cable end 52, thereby staking free cable end 52 in place and simultaneously causing the uniform diameter of cable 50 to expand and become enlarged at the point of locking pin 40 penetration, thus creating a cable bulge 53 to occur within center expansion cavity 25 within locking body 10.

FIGS. 2 and 2A show locking pin 40 in its closed, and locked position with locking pin flat end 43 flush with the top surface of locking body 10. The various strands of the multi-stranded free cable end 52 are shown separated by the shaft of locking pin 40 with the tip of locking pin tapered end 41 positioned within locking pin tip recess 35, thus staking free cable end 52 in place and simultaneously creating a cable bulge 53 within center expansion cavity 25. FIGS. 2 and 2A illustrates the one-piece pierce-lock double-engagement cable-seal in its preferred first embodiment in its closed and locked position as it would be when installed on the locking hasp of a cargo container.

The one-piece pierce-lock double-engagement cable-seal achieves its locked and secured position by means of two interrelated methods. Once locking pin 40 fully pierces free cable end 52, the cable becomes firmly staked and secured in position, thereby creating the first locking engagement method. At the point of locking pin 40 penetration, a cable bulge 53 is simultaneously created within center expansion cavity 25. The dimensional differential between the expanded diameter of cable bulge 53 and the lessor diameters of first guide hole 20 and second guide hole 22 creates the second locking engagement method. An attempt to forcibly pull and remove free cable end 52 from locking body 10 is prevented since free cable end 52 is securely staked into position by locking pin 40 and the expanded diameter of cable bulge 53 cannot possibly pass through the lessor diameter guide holes 20 or 22 respectively. Thus, creating a positive double-engagement locking mechanism that cannot be forcibly opened, or manipulated and slipped open.

The manner of installing the preferred first embodiment of the one-piece pierce-lock double-engagement cable-seal is similar to that for other one-piece cable-lock seals presently in use. Namely, the user first inserts and threads the free end of the cable into and through the locking hasp of a container/rail-car/or trailer door, and then, creating a loop or shackle with the flexible cable member, then inserts the free end of the cable into the main body of the seal where it is secured in place by one securement manner or another. To remove a locked and secured cable-lock seal, the exposed looped cable member of the seal, which secures the hasp, is typically cut with a suitable cable cutting tool. Thus, and ideally, rendering the seal destroyed and unusable for a second use.

FIGS. 1 and 1A illustrates the preferred first embodiment of the one-piece pierce-lock double-engagement cable-seal in its un-secured open position as it would appear when first installed on a hasp, and just prior to being locked and secured. Cable 50 would be looped through the hasp of a cargo container, and then inserted into first guide hole 20 and then pushed completely through longitudinal cylindrical through hole 14 of locking body 10. The user of this invention could choose to pull the cable loop to fit snugly around the hasp, or leave the cable loop fitting loosely. Once this invention is installed on the hasp, the user would secure and lock this invention by utilizing any suitable tool which presses locking pin 40 downward until locking pin flat end 43 is flush with the top surface of locking body 10. Thus, locking pin 40 secures free cable end 52 in place by penetrating and staking the multi-stranded cable fibers of free cable end 52, which also results in the simultaneous creation of cable bulge 53 within center expansion cavity 25 as illustrated in FIGS. 2 and 2A.

Following securement of this invention, cable bulge 53 becomes larger in diameter than the uniform diameter of cable 50. Therefore, if an attempt were made to pull free cable end 52 out of locking body 10 the increased diameter of cable bulge 53 within center expansion cavity 25 is such that the lessor diameters of first guide hole 20 and second guide hole 22 would prevent free cable end 52 from passing through either adjacent guide holes regardless of the amount of force being applied to free cable end 52. Thus, positively securing free cable end 52 within center expansion cavity 25 and eliminating any potential for this invention to be compromised by means of force, manipulation, or slippage. To effect removal, the looped portion of cable 50 must be cut, thus resulting in this invention being totally destroyed and rendered non-reusable.

Additionally, if an attempt were made to compromise this invention by "short cutting" the cable at the point where free cable end 52 first enters locking body 10, this invention would continue to function properly, since the double-engagement locking mechanism would continue to secure the remains of the "short cut" length of free cable end 52 within locking body 10, thus preventing the removal of free cable end 52 from longitudinal cylindrical through hole 14. Thereby, positively preventing the potential for re-inserting the remaining, but shorter, attached length of cable 50 into the now permanently blocked longitudinal cylindrical through hole 14. Thus, the illegal procedure of "short cutting" would be ineffective in compromising this invention.

The function, operation, and security of the preferred first embodiment of this invention is equally effective regardless of which direction free cable end 52 is inserted through longitudinal cylindrical through hole 14 due to the identical size and structure of first guide hole 20 and second guide hole 22 which are located on either side of, and adjacent to, center expansion cavity 25. (Due to its obviousness, the alternate insertion method is not shown in FIGS.)

A preferred second embodiment of this invention is illustrated in FIGS. 3, 3A, 4, and 4A. All features and functions indicated in the preferred first embodiment of this invention are present in the second embodiment with the following exceptions, thereby creating a variation of the preferred first embodiment.

The longitudinal cylindrical through hole 14 described in the preferred first embodiment above, is structurally altered in the second embodiment in the following manner: First guide hole 20 remains unchanged from the preferred first embodiment. Second guide hole 22 is replaced by exit guide hole 24, and center expansion cavity 25 is replaced by exit oriented expansion cavity 26. The collective alterations and revised through hole configuration of the second embodiment are generally referred to as exit oriented through hole 15.

Figure 3:
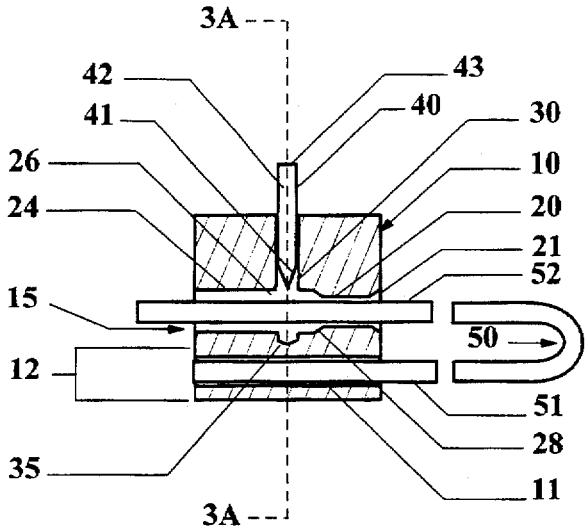
FIG. 3 is a vertical sectional view of a second embodiment of the pierce-lock double-engagement cable-seal, having an exit oriented expansion cavity. This view represents the pierce-lock double-engagement cable-seal, with one end of the cable permanently installed within the locking body, and the free end of the multi-stranded flexible cable fully inserted through the longitudinal cylindrical through hole of the locking body, with the locking pin held in an open, un-locked position.

Exit guide hole 24, shown in FIG. 3 of the second embodiment, is the same diameter as the largest diameter of the annular recessed groove which creates exit oriented expansion cavity 26, thereby resulting in a uniform diameter hole which extends from the largest diameter of exit oriented expansion cavity 26 through exit guide hole 24, to the cable exit point of locking body 10. First guide hole 20, exit guide hole 24, and exit oriented expansion cavity 26 are horizontally aligned on their respective center lines to permit free cable end 52 to pass freely through these areas which collectively comprise exit oriented through hole 15.

The structural variation of exit oriented through hole 15 of the second embodiment of this invention results in exit guide hole 24 having a larger diameter than first guide hole 20. Therefore, for the second embodiment of the one-piece pierce-lock double-engagement cable-seal to maintain total effectiveness and security protection, the alternate insertion method of free cable end 52 permitted by the preferred first embodiment is not permitted with the second embodiment. Therefore, the second embodiment requires that the initial insertion of free cable end 52 must be made into and through first guide hole 20 only. FIG. 3 shows free cable end 52 first inserted into first guide hole 20, and then passing through locking body 10 and exiting via exit guide hole 24. For the second embodiment of this invention to be totally effective and secure from a forced entry and manipulation, no alternate insertion method of free cable end 52 is available to the user of this second embodiment.

Figure 3A:
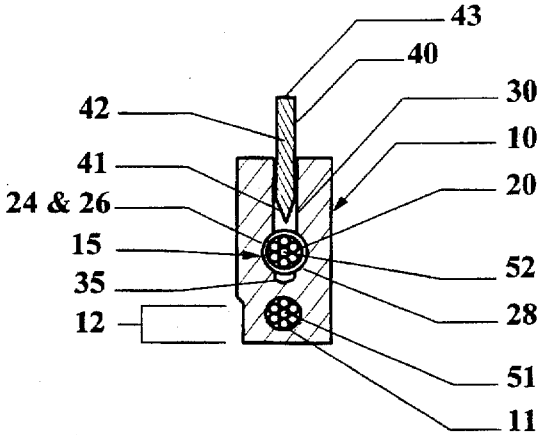
FIG. 3A is a cross-sectional view of FIG. 3 shown along viewing line 3A—3A of FIG. 3.

FIGS. 3 and 3A illustrates the second embodiment of the one-piece pierce-lock double-engagement cable-seal in its open, un-locked position as it would appear to the user of this invention just prior to securement.

Figure 4:
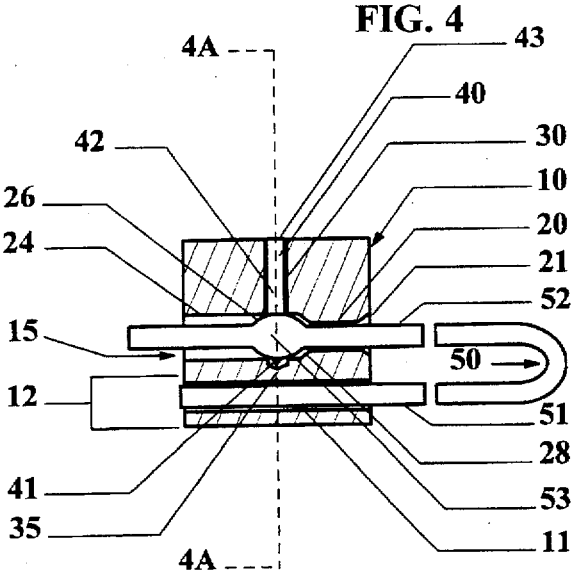
FIG. 4 is a vertical sectional view of the second embodiment of the pierce-lock double-engagement cable-seal, having an exit oriented expansion cavity, of FIG. 3, shown with the locking pin in its closed and fully engaged locked position, thereby piercing the free end of the multi-stranded flexible cable causing the cable to bulge at the point of locking pin penetration, thus permanently securing the cable in place.
Figure 4A:
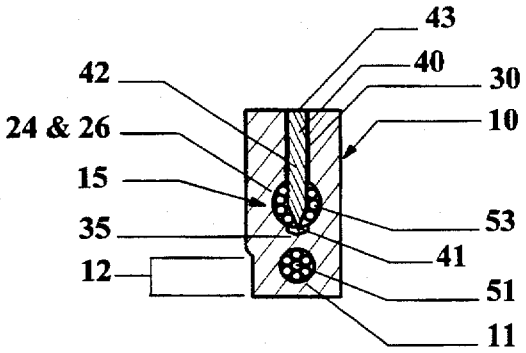
FIG. 4A is a cross-sectional view of FIG. 4 shown along viewing line 4A—4A of FIG. 4.

FIGS. 4 and 4A illustrates the second embodiment of the one-piece pierce-lock double-engagement cable-seal in its fully locked and secured position as it would appear when installed and locked on the hasp of a cargo container.

The second embodiment of the one-piece pierce-lock double-engagement cable-seal achieves its locked and secured position by means of two interrelated methods. Once locking pin 40 fully pierces free cable end 52, the cable becomes firmly staked and secured in position, thereby creating the first locking engagement method. At the point of locking pin 40 penetration, a cable bulge 53 is simultaneously created within exit oriented expansion cavity 26. The dimensional differential between the expanded diameter of cable bulge 53 and the lessor diameter of first guide hole 20 creates the second locking engagement method. An attempt to forcibly pull and remove free cable end 52 from locking body 10 is prevented since free cable end 52 is securely staked into position by locking pin 40 and the expanded diameter of cable bulge 53 cannot possibly pass through the lessor diameter guide hole 20. Thus creating a positive double-engagement locking mechanism that cannot be forcibly removed, or be manipulated and slipped open.

The manner of installing the preferred second embodiment of the one-piece pierce-lock double-engagement cable-seal is similar to that for other one-piece cable-lock seals presently in use. Namely, the user first inserts and threads the free end of the cable into and through the locking hasp of a container/rail-car/or trailer door, and then, creating a loop or shackle with the flexible cable member, then inserts the free end of the cable into the main body of the seal where it is secured in place by one securement manner or another. To remove a locked and secured cable-lock seal, the exposed looped cable member of the seal, which secures the hasp, is typically cut with a suitable cable cutting tool. Thus, and ideally, rendering the seal destroyed and unusable for a second use.

FIGS. 3 and 3A illustrates the second embodiment of the one-piece pierce-lock double-engagement cable-seal in its un-secured open position as it would appear when first installed on a hasp, and just prior to being locked and secured. Cable 50 is looped through the hasp of a cargo container, and then inserted into first guide hole 20 and then pushed completely through the exit oriented through hole 15 of locking body 10. The user of this invention could choose to pull the cable loop to fit snugly around the hasp, or leave the cable loop fitting loosely. Once this invention is installed on the hasp, the user would secure and lock this invention by utilizing any suitable tool which presses locking pin 40 downward until locking pin flat end 43 is flush with the top surface of locking body 10. Thus, locking pin 40 secures free cable end 52 in place by penetrating and staking free cable end 52, which results in the simultaneous creation of cable bulge 53 within exit oriented expansion cavity 26 as illustrated in FIGS. 4 and 4A.

Following securement of this invention, cable bulge 53 becomes larger in diameter than the uniform diameter of cable 50. Therefore, if an attempt were made to pull free cable end 52 out of locking body 10 the increased diameter of cable bulge 53 within exit oriented expansion cavity 26 is such that the lessor diameter of first guide hole 20 would prevent free cable end 52 from passing through first guide hole 20 regardless of the amount of force being applied to free cable end 52. Thus, positively securing free cable end 52 within exit oriented expansion cavity 26 and eliminating any potential for this invention to be compromised by means of force, manipulation, or slippage. To effect removal, the looped portion of cable 50 must be cut, thus resulting in this invention being totally destroyed and rendered non-reusable.

Additionally, if an attempt were made to compromise this invention by "short cutting" the cable at the point where free cable end 52 first enters locking body 10 via first guide hole 20, the larger exit guide hole 24 may possibly permit the careful manipulation and removal of the individual strands of the cable remains of "short cut" free cable end 52 from exit oriented through hole 15 of this embodiment. However, locking pin 40 would remain in its fully locked and secured position, thus fully blocking exit oriented expansion cavity 26, and thus preventing any potential for re-inserting the remaining, but shorter, attached length of cable 50 into the now blocked exit oriented expansion cavity 26, and through exit oriented through hole 15. Thus, the illegal procedure of "short cutting" would be ineffective in compromising this invention.

The function, operation, and security of the second embodiment of this invention is effective when free cable end 52 is first inserted into first guide hole 20 and then passing completely through exit oriented through hole 15 as shown in FIG. 3. An alternative insertion method is not recommended for the second embodiment of this invention.

Figure 5:
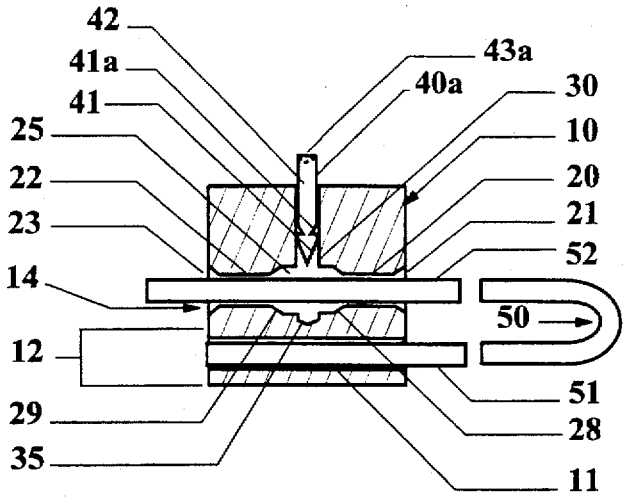
FIG. 5 is a vertical sectional view of the preferred first embodiment of the pierce-lock double-engagement cable-seal of FIG. 1, showing several locking pin variations. This figure shows a short style locking pin held in its open position within the locking body. This figure also shows several additional locking pin embodiments, including a concave end, and a locking pin cable recess. Any one, none, or all, of the indicated locking pin variations may be included in this invention.
Figure 6:
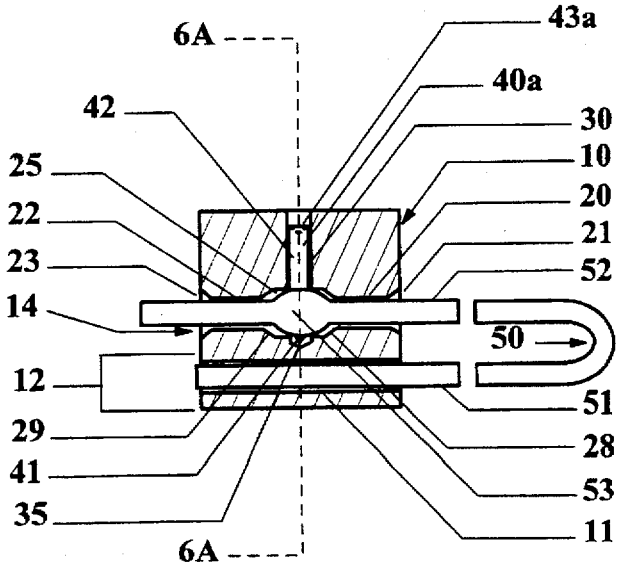
FIG. 6 is a vertical sectional view of the preferred first embodiment of the pierce-lock double-engagement cable-seal of FIG. 5 shown with the short style locking pin in its closed and fully engaged locked position, thereby piercing the free end of the multi-stranded flexible cable causing the cable to bulge at the point of locking pin penetration, thus permanently securing the cable in place. The fully engaged short style locking pin is counter sunk below the surface of the locking body further enhancing its inaccessibility.
Figure 6A:
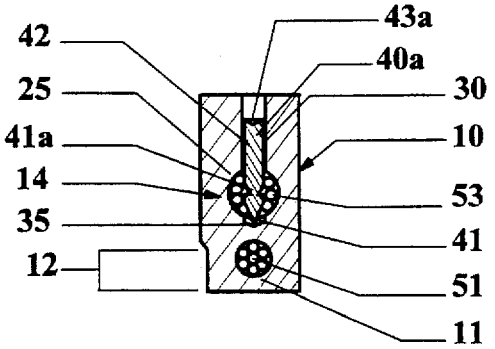
FIG. 6A is a cross-sectional view of FIG. 6 shown along viewing line 6A—6A of FIG. 6. This view clearly shows the locking pin cable recess surrounded by the expanded cable fibers, further enhancing the locking pin's engagement with the cable.

An alternative variation and enhancement of locking pin 40, which had been previously described in FIGS. 1, thru 4A, is shown in FIGS. 5, 6, and 6A. All functions and features of the embodiments shown in FIGS. 1, thru 4A remain as shown except for the variations and enhancements collectively described and identified as short locking pin **40*a* in FIGS. 5, 6, and 6A**.

FIGS. 5, 6, 6A illustrate the enhanced variation short locking pin 40*a*. For illustration purposes only, the enhanced variations of short locking pin 40*a* are shown with the preferred first embodiment of the one-piece pierce-lock double-engagement cable-seal, however, the enhanced variations of short locking pin 40*a* would equally apply to the second embodiment of this invention.

Short locking pin 40*a* is a cylindrical shaft constructed of any suitable material having sufficient strength, rigidity, and hardness, to facilitate penetration, expansion, and securement of free cable end 52. Short locking pin 40*a* has an outside diameter which is equal to the diameter of locking pin guide hole 30, providing only adequate minimal clearance to allow short locking pin 40*a* to slide within locking pin guide hole 30. Short locking pin 40*a* is held in place within locking pin guide hole 30 by means of friction which is created by either the close tolerance fit between short locking pin 40*a* and locking pin guide hole 30, or any suitable texture or surface treatment applied to the cylindrical surface of short locking pin 40*a* and identified as locking pin textured surface 42. The close tolerance fit, or locking pin textured surface 42, holds short locking pin 40*a* firmly in place within locking pin guide hole 30 in both its open position as shown in FIGS. 5 and in its closed position as shown in FIGS. 6 and 6A, thus creating a one-piece seal.

The enhanced variation of short locking pin 40*a* as illustrated in FIGS. 5, 6, and 6A has the following enhanced features not present on standard locking pin 40 previously illustrated in FIGS. 1 thru 4A: The exposed end of short locking pin 40*a* is made with a concave end 43*a* which provides increased protection from tampering and provides centering support for a suitable insertion tool which may have a mating convex member. Short locking pin 40*a* is shorter in overall length than standard locking pin 40, therefore, permitting short locking pin 40*a* to be counter-sunk below the top surface of locking body 10 when fully inserted in its closed, and locked position as shown in FIG. 6 and 6A. Thus, with concave end 43*a* counter-sunk below the top surface of locking body 10, short locking pin 40*a* provides an added level of inaccessibility.

An additional enhancement is also shown on short locking pin 40*a* and is identified as locking pin cable recess 41*a*. Locking pin cable recess 41*a* is an annular groove around short locking pin 40*a* and is located just above locking pin tapered end 41, in a location that when short locking pin 40*a* is fully inserted to its closed, and locked position, locking pin cable recess 41*a* is positioned within cable bulge 53 and subsequently surrounded by the multi-stranded fibers of the cable as shown in FIG. 6A. The size and shape of locking pin cable recess 41*a* will vary depending on the type, style, and size of multi-stranded cable used. Locking pin cable recess 41*a* should be of suitable size and shape to permit the individual strands of multi-stranded cable 50 to catch on locking pin cable recess 41*a*. The natural tendency of the individual strands of multi-stranded flexible cable 50 to return to its normal, non-expanded, position will cause the individual cable strands to move into locking pin cable recess 41*a* as short locking pin 40*a* is pressed into its closed, and locked position. Thus, locking pin cable recess 41*a* offers added security protection from tampering or manipulation by further securing short locking pin 40*a* in its fully closed, and locked position utilizing the added presence of the individual strands of the multi-stranded cable 50 as shown in FIG. 6A to achieve an added level of protection from tampering or manipulation.

FIGS. 6 and 6A illustrates the one-piece pierce-lock double-engagement cable-seal with the enhanced variation short locking pin 40*a* in its closed, and locked position as it would appear when installed on the locking hasp of a cargo container.

The manner of using the preferred first embodiment, or the preferred second embodiment, of the one-piece pierce-lock double-engagement cable-seal with enhanced short locking pin 40*a*, shown in FIGS. 5, 6, and 6A, remains consistent with the descriptions mentioned above for each embodiment with the following exception:

Once this invention is installed on the hasp, the user would secure and lock this invention by utilizing any suitable tool which presses short locking pin 40*a* downward until locking pin concave end 43*a* becomes counter-sunk below the top surface of locking body 10. Downward pressure is applied to short locking pin 40*a* until the tip of locking pin tapered end 41 comes in contact with locking pin tip recess 35 and further downward movement of short locking pin 40*a* is prevented, thereby indicating to the user of this invention that short locking pin 40*a* is fully engaged. Thus, short locking pin 40*a* secures free cable end 52 in place by penetrating and staking the multi-stranded cable fibers of free cable end 52, which also results in the simultaneous creation of cable bulge 53 within center expansion cavity 25 as illustrated in FIGS. 6 and 6A.

Once secured, short locking pin 40*a*, and this invention, functions in the same manner as when the longer length standard locking pin 40 was used. Following securement of this invention, cable bulge 53 becomes larger in diameter than the uniform diameter of cable 50. Therefore, if an attempt were made to pull free cable end 52 out of locking body 10 the increased diameter of cable bulge 53 within center expansion cavity 25 is such that the lessor diameters of first guide hole 20 and second guide hole 22 would prevent free cable end 52 from passing through either adjacent guide holes regardless of the amount of force being applied to free cable end 52. Thus, positively securing free cable end 52 within center expansion cavity 25 and eliminating any potential for this invention to be compromised by means of force, manipulation, or slippage. To effect removal, the looped portion of cable 50 must be cut, thus resulting in this invention being totally destroyed and rendered non-reusable.

Locking pin cable recess 41*a* further enhances short locking pin 40*a*'s stability and security by permitting individual strands of the multi-stranded flexible cable to "catch", or become nestled within locking pin cable recess 41*a*, thereby providing additional resistance to any form of manipulation which would attempt to remove short locking pin 40*a* from locking body 10.

Additionally, short locking pin 40*a*'s stability and security is further enhanced by having concave end 43*a* counter-sunk below the top surface of locking body 10, thereby, creating additional resistance to any form of manipulation which would attempt to remove short locking pin 40*a* from locking body 10.

Accordingly, the reader will see that the one-piece pierce-lock double-engagement cable-seal provides a double-engagement locking mechanism which utilizes the inherent properties of the multi-stranded flexible cable, combined with a unique internal cavity configuration which permits the penetration and securement of the multi-stranded flexible cable by means of a suitable locking pin, thereby staking and securing the cable in place, while simultaneously creating a bulge, or dimensional enlargement of the cable, at the point of penetration. The unique internal expansion cavity configuration permits the cable to expand beyond its normal uniform diameter, while the adjacent lessor diameter through holes prevent the enlarged cable bulge from passing through and out of the locking body. Thus, permanently locking and securing the one-piece pierce-lock double-engagement cable-seal in place.

Although the above specifications contain many specifics, these should not be construed as limiting the scope of the invention but as merely providing illustrations of some of the presently preferred embodiments of this invention. Modifications may be made to the device without departing from the scope of the invention, it is intended that all matter contained herein be interpreted in an illustrative and not a limiting sense. Many other variations are possible but are not considered important enough to show as ramifications in the FIG's. For example: The general configuration of the locking body can vary in size, dimension, shape and material. The method for securing the fixed cable end within the locking body may vary as long as any securement method provides suitable holding strength and adequate tamper resistance. The position, location, and directional orientation of the fixed cable end may vary to suit special applications or seal design variations. The position, location and directional orientation of the longitudinal cylindrical through hole may vary to suit special applications or seal design variations. The locking pin design, shape, length, angular position or method of penetrating the free cable may vary.

Other modifications and variations are possible without departing from the scope of the invention. Thus the scope of the invention should be determined by the appended claims and their legal equivalent rather than by the examples given.

I claim as my invention:

1. A one-piece permanently secured double engagement cable type seal-lock comprising:

(a) a locking body, a multi-stranded flexible cable, and a locking pin, (b) said locking body having one end of said multi-stranded flexible cable permanently fixed or attached to said locking body by a suitable permanent attachment means and, prior to installation, having the opposite end of said multi-stranded flexible cable free and unattached from said locking body, (c) said locking body having a longitudinal through hole having a diameter approximately similar to the uniform diameter of said multi-stranded flexible cable but of sufficient diameter to permit the unobstructed free passage of said unattached free end of said multi-stranded flexible cable into and through said locking body, (d) said longitudinal through hole having a centrally located and horizontally aligned annular recessed groove of sufficient length and diameter to create an expansion cavity within said locking body, with said centrally located expansion cavity resulting in said longitudinal through hole having a first guide hole and a second guide hole, each of which is generally horizontally aligned with, located adjacent to, and located on either side of, said expansion cavity, (e) said locking body having a locking pin guide hole positioned approximately perpendicular to, and centrally located and vertically aligned with, said expansion cavity, with said locking pin guide hole being a blind hole which passes into and through said expansion cavity to further create a locking pin tip recess within the opposite internal wall of said expansion cavity, (f) a locking pin made from a suitable material having sufficient strength and rigidity to prevent bending or deflection when forcibly pressed or driven into and through said multi-stranded flexible cable member, (g) said locking pin having a tapered point at one end suitably fashioned to facilitate the penetration and expansion of said multi-stranded flexible cable member, while the opposite end of said locking pin suitably fashioned to provide a surface which facilitates the urging or the application of pressure or force upon said locking pin by any suitable means for the purpose of facilitating said penetration and expansion of said multi-stranded flexible cable member, (h) said locking pin held in place within said locking pin guide hole by a suitable friction means which holds said locking pin within said locking pin guide hole prior to, and after installation, while permitting slidable movement of said locking pin within said locking pin guide hole upon the urging or the application of pressure or force upon the exposed end of said locking pin, (i) with said locking body positioned in proximity of a hasp to be sealed, said unattached free end of said multi-stranded flexible cable is threaded into and through the aperture of said hasp, then said unattached free end of said multi-stranded flexible cable is looped around and inserted into said longitudinal through hole via said first guide hole of said locking body and pushed completely through said longitudinal through hole, thus having said multi-stranded flexible cable create a closed loop or shackle and securing said hasp, whereupon the exposed end of said locking pin is pushed downward, by any suitable means for applying such downward pressure, thereby causing said locking pin to pierce and penetrate the portion of said multi-stranded flexible cable located within said expansion cavity, thus staking said multi-stranded flexible cable in place and simultaneously creating a cable bulge within said expansion cavity at the point where said multi-stranded flexible cable is penetrated by said locking pin, thus creating a dimensional differential between the larger diameter of said cable bulge and the lessor diameters of said first and second guide holes of said longitudinal through hole, thus permanently securing said multi-stranded flexible cable within said locking body.

2. A seal-lock as defined in claim 1 having the top surface of said locking pin being flush with the top surface of said locking body once said locking pin has fully penetrated and expanded said multi-stranded flexible cable.

3. A seal-lock as defined in claim 1 having a shorter locking pin being counter-sunk below the top surface of said locking body once said locking pin has fully penetrated and expanded said multi-stranded flexible cable.

4. A seal-lock as defined in claim 1 having a locking pin with said locking pin tip fashioned with a suitable annular recessed groove whereby once said locking pin has fully penetrated and expanded said multi-stranded flexible cable said annular recessed groove of said locking pin engages an individual strand or strands of said multi-stranded flexible cable.

5. A seal-lock as defined in claim 1 having the top surface of said locking pin configured concave to assist and facilitate the urging and application of pressure on said locking pin.

6. A seal-lock as defined in claim 1 having said longitudinal through hole alternatively having a suitably sized entrance guide hole having a diameter similar to the uniform diameter of said multi-stranded flexible cable member, and a centrally located and horizontally aligned annular recessed groove of sufficient length and diameter to create an exit oriented expansion cavity within said locking body, and an exit guide hole having a similar diameter as the largest diameter of the annular recessed groove which created said exit oriented expansion cavity.

7. A seal-lock as defined in claim 1 having said longitudinal through hole having a series of annular bevels for the purpose of facilitating the entrance, guidance, and passage of said multi-stranded flexible cable.

8. A seal-lock having a locking body with one end of a pre-determined length of a multi-stranded flexible cable permanently attached to said locking body, with said locking body having a through hole which is a similar diameter to said multi-stranded flexible cable, which permits the insertion and passage of the free end of said multi-stranded flexible cable into and through said locking body, with said through hole having an internal annular recessed cavity of sufficient length and diameter to create an expansion cavity within said through hole, and having the center line of the expansion cavity horizontally aligned with the through hole center line, and positioned away from the original cable entrance point, thereby retaining the lessor diameter of the through hole cable entrance point, with said locking body providing a means for expanding the uniform diameter of said multi-stranded flexible cable within said annular expansion cavity, thereby creating a dimensional differential between the larger diameter of said expanded cable member and the lessor diameter of the cable through hole entrance point, thereby permanently securing said multi-stranded flexible cable within said locking body by means of a dimensional differential between the expanded diameter of the multi-stranded flexible cable and the lessor diameter of the through hole entrance point.

* * * * *